US007381007B2

(12) United States Patent
Shaw et al.

(10) Patent No.: US 7,381,007 B2
(45) Date of Patent: Jun. 3, 2008

(54) MONOLITHIC POUR CRACK CONTROL SYSTEM AND METHOD OF USE

(75) Inventors: Lee A. Shaw, Newport Beach, CA (US); Ronald D. Shaw, Corona Del Mar, CA (US)

(73) Assignee: Shaw & Sons, Inc., Costa Mesa, CA (US)

( * ) Notice: Subject to any disclaimer, the term of this patent is extended or adjusted under 35 U.S.C. 154(b) by 0 days.

(21) Appl. No.: 11/890,344

(22) Filed: Aug. 6, 2007

(65) Prior Publication Data

US 2008/0056821 A1 Mar. 6, 2008

Related U.S. Application Data

(63) Continuation of application No. 11/514,566, filed on Sep. 1, 2006, now Pat. No. 7,334,962.

(51) Int. Cl.
*E01C 11/04* (2006.01)

(52) U.S. Cl. ..... 404/48; 404/68; 52/396.02; 52/396.03; 52/402

(58) Field of Classification Search ..... 52/396.02, 52/396.03, 396.04, 402; 404/47, 48, 64, 404/68, 69, 75

See application file for complete search history.

(56) References Cited

U.S. PATENT DOCUMENTS

| | | | | |
|---|---|---|---|---|
| 1,769,990 | A | | 7/1930 | Fischer |
| 1,891,530 | A | | 12/1932 | Galassi |
| 1,958,391 | A | | 5/1934 | Hall et al. |
| 1,997,216 | A | | 4/1935 | Heltzel |
| 2,949,828 | A | | 8/1960 | Carnes |
| 3,157,097 | A | * | 11/1964 | Stinnett, Jr. et al. ..... 52/127.3 |
| 3,368,464 | A | * | 2/1968 | Thorp, Jr. et al. ..... 404/74 |
| 3,838,930 | A | | 10/1974 | Koch |
| 3,967,911 | A | | 7/1976 | Miers |
| 4,008,974 | A | | 2/1977 | Miers |
| 4,128,358 | A | | 12/1978 | Compton |
| 4,190,997 | A | | 3/1980 | Holt |
| 4,198,176 | A | | 4/1980 | Bentz |
| 4,388,016 | A | | 6/1983 | Levey |
| 4,748,788 | A | | 6/1988 | Shaw et al. |
| 4,889,455 | A | | 12/1989 | Karlsson et al. |
| 5,042,211 | A | | 8/1991 | Nestler |
| 5,092,091 | A | | 3/1992 | Hull et al. |

(Continued)

OTHER PUBLICATIONS

Sandell Manufacturing Co., Inc.; "Sandell's Zip Strip & Expansion Joint"; 2 pgs.

(Continued)

*Primary Examiner*—Gary S Hartmann
(74) *Attorney, Agent, or Firm*—Stetina Brunda Garred & Brocker

(57) ABSTRACT

A joint assembly for controlling fractures along a fracture axis in a monolithic pour concrete structure is provided. The concrete structure is defined by a first edge form section and a generally opposed second edge form section. The joint assembly is characterized by a suspension line extending between the first edge form section and the second edge form section, and a fracture inducing sheath suspended therefrom within the concrete structure. The sheath may define an elongate slit that exposes an internal channel that the suspension line traverses. Additionally, a method for forming a control joint in a monolithic pour concrete structure via the joint assembly is provided.

6 Claims, 7 Drawing Sheets

U.S. PATENT DOCUMENTS

| | | | |
|---|---|---|---|
| 5,450,699 | A | 9/1995 | Lee |
| 5,888,017 | A | 3/1999 | Corrie |
| 5,910,087 | A | 6/1999 | Carter |
| 5,956,912 | A | 9/1999 | Carter et al. |
| 6,092,960 | A | 7/2000 | McCallion |
| 6,171,016 | B1 | 1/2001 | Pauls et al. |
| 6,739,805 | B2 | 5/2004 | Shotton |
| 7,334,962 | B1 * | 2/2008 | Shaw et al. ..... 404/48 |

OTHER PUBLICATIONS

PNA Construction Technologies; "PNA Square Dowel Basket Isometric"; 2 pgs.

* cited by examiner

MONOLITHIC POUR CRACK CONTROL SYSTEM AND METHOD OF USE

CROSS-REFERENCE TO RELATED APPLICATIONS

The present application is a continuation of U.S. patent application Ser. No. 11/514,566 entitled MONOLITHIC POUR CRACK CONTROL SYSTEM AND METHOD OF USE filed Sept. 1, 2006 now U.S. Pat. No. 7,334,962, the entirety of the disclosures of which are expressly incorporated herein by reference.

STATEMENT RE: FEDERALLY SPONSORED RESEARCH/DEVELOPMENT

Not Applicable

BACKGROUND OF THE INVENTION

1. Technical Field

The present invention generally relates to devices and methods employing such devices for concrete paving. More particularly, the present invention relates to devices and methods for crack control in monolithic pour concrete paving.

2. Related Art

Concrete is widely used in a variety of construction, projects, in particular, in pavement structures such as sidewalks, roads, highways, runways, and other flat and open spaces. However, it is well known that such concrete structures frequently exhibit cracking along unpredictable lines due to thermal expansion and contractions, shrinkage resulting from hydration during the curing process, and stresses applied thereto from foot and vehicular traffic. Typical contraction rates for concrete are about one-sixteenth of an inch for every ten feet of length. A number of effective techniques are known for controlling the location and direction of the cracks. These techniques generally involve segregating large concrete pours into smaller segments that allow the concrete to crack in straight lines along the joint between the segments as expansion and contraction occurs.

One method involves placing forms in a checkerboard pattern. A first batch of plastic/wet concrete is poured into alternating areas of the checkerboard pattern. After curing, the forms may be removed and expansion joint material may be positioned adjacent to edges of the cured area. Thereafter, the remaining areas in the checkerboard pattern are poured with a second batch of plastic concrete. This technique is referred to in the art as forming "cold joints" between the first concrete pour and the second concrete pour. Further, as a means of preventing bucking or angular displacement of such cold joints, it is common practice to insert smooth steel dowel rods generally known as "slip dowels" within the edge portions of adjoining concrete blocks in such a manner that the concrete blocks may slide freely along one or more of the slip dowels, permitting linear expansion and contraction of the blocks while also maintaining the blocks in a common plane and thus preventing undesirable bucking or unevenness of the cold joint. As will be appreciated by those having ordinary skill in the art, the aforementioned method is both labor intensive and time consuming because of multiple curing steps and the requirement of removing the forms after each such curing step.

Alternatively, the entire structure may be constructed with a single pour of concrete, the technique otherwise referred to as a monolithic pour. While some monolithic pour techniques utilize forms and dowels embedded within the structure much like the multiple-pour techniques, other techniques involve no intermediate forms segregating one segment from the other. Control joints were utilized instead, which were deliberately weakened sections of the poured concrete. During expansion and/or contraction, these weakened sections were the first to crack, thereby forming sections of the concrete structure that transform independently of another.

One common way of forming such a control joint is by saw-cutting an elongate groove through the upper surface portion of the structure after partial curing of the concrete. This technique was unsatisfactory in a number of respects. Sawing grooves within concrete is expensive and tedious work, and requires an intermediate visit to the site after the concrete has been poured and allowed to partially cure. If an attempt is made to cut the grooves within the concrete at too early of a time, the grooves will have undesirably irregular configurations. On the other hand, if too much time is allowed to elapse before cutting the grooves, random cracking and separation of the concrete will occur at other locations in the structure. Additionally, the finished control joints are wide and unsightly, and the edges of the concrete defining the control joints are subject to considerable degradation over time. Manual sawing often results in crooked grooves, and although machinery has been developed to correct this deficiency, such machinery is cumbersome to operate and expensive to acquire.

On a related note, most conventional concrete pavement utilize Portland cement concrete, which will be appreciated as being a dull, gray color upon curing. Accordingly, there is a demand for variations in color and surface texture of concrete such that the concrete posses improved aesthetics similar to traditional flooring surfaces such as marble, stone and granite. Surface seeded exposed aggregate concrete such as that disclosed in U.S. Pat. No. 4,748,788 to Shaw, et al., has met this demand.

In addition to the deficiencies described above, it is understood that sawing grooves in surface seeded aggregate concrete is particularly deficient. Since the aggregate is suspended in the concrete, sawing into the same resulted in the aggregate becoming dislodged from the remainder of the concrete. This results in less desirable surface aesthetics, and weakens structural integrity by leaving pockets in the concrete.

Alternative techniques have been considered that avoid the problems of sawing grooves to form control joints, such as the "Zip Strip" expansion joint manufactured by Sandell Manufacturing Company, Inc. of Schenactady, N.Y. The Zip Strip includes an elongate rail with a removable cap. The rail is inserted into wet concrete, and the cap suspends the assembly in the concrete. Upon partially curing the concrete, only the cap is removed, and the rail provides a weakness in the concrete from which a crack or fracture can occur. Although capable of being used with surface-seeded aggregate concrete as discussed above, one deficiency with the Zip Strip was that the rail remained visible upon completion since it was necessary for the same to remain within the concrete after curing. Additionally, it is difficult to properly align the rail and the cap in plastic concrete, particularly where multiple control joints are involved.

Accordingly, there is a need in the art for an improved crack control device for use in conjunction with monolithic pour concrete structures and techniques for constructing the same, such devices and methods overcoming the deficiencies in the art as set forth above.

BRIEF SUMMARY OF THE INVENTION

In light of the foregoing limitations, the present invention was conceived. In accordance with one aspect of the present invention, there may be a joint assembly for controlling fractures along a fracture axis in a monolithic pour concrete structure. The concrete structure may be defined by a first edge form section and a generally opposed second edge form section. The joint assembly may include an upper suspension line extending between the first edge form section and the second edge form section along the fracture axis. The upper suspension line may define a proximal end fixed to the first edge form section and a distal end fixed to the second edge form section. The joint assembly may also include a fracture inducing sheath that defines an elongate slit. The slit may expose an upper internal channel defined by the sheath. The slit and the upper internal channel may extend along the length of the sheath to define open ends thereof. The upper suspension line may traverse the upper internal channel to suspend the sheath within the concrete structure. The width of the slit may be smaller than the width of the upper internal channel to retain the upper suspension line therein.

According to another aspect of the present invention, the joint assembly may also include a lateral reinforcement assembly. The lateral reinforcement assembly may include a plurality of reinforcement members disposed transversely across the fracture axis and the sheath. Each reinforcement member may have a sleeve and a tubular dowel inserted therein. The lateral reinforcement assembly may further include a basket assembly with a plurality of interconnecting members attaching one of the support members to another one of the support members.

In yet another aspect of the present invention, the joint assembly may include fasteners that secure the proximal and distal ends of the upper suspension line to the respective one of the first and second edge form sections. The first edge form section and the second edge form section may each define an upper surface, with the fasteners drive though the upper surface.

In a second embodiment of the invention, there may be a lower suspension line extended between the first edge form section and the second edge form section. The lower suspension line extends along the fracture axis in parallel relation to the upper suspension line, and may define a proximal end fixed to the first edge form section and a distal end fixed to the second edge form section. The distance between the upper suspension line and the lower suspension line may approximately be a third of the height of the first and second edge form sections. In order to accommodate the lower suspension line, the fracture inducing sheath in accordance with the second embodiment of the present invention defines a lower internal channel extending along the length of the sheath. In this regard, the lower suspension line traverses the lower internal channel. The fracture inducing sheath may be segregated into an upper portion and a lower portion by the slit that may be defined by a side wall portion of the sheath.

In accordance with another aspect of the second embodiment of the invention, there may be a bracket having a horizontal section that defines a first attachment point for the upper suspension line, and a vertical section defining a second attachment point for the lower suspension line. The first attachment point and the second attachment point may be in alignment with the fracture axis. The first attachment point of the bracket may include a fastener aperture, and the second attachment point may include a line retention notch. There may also be a fastener that secures the proximal end of the upper suspension line to the first edge form section. More particularly, the fastener may be inserted through the fastener aperture into the first edge form section. The lower suspension line may be engaged to the line retention notch. In another aspect of the present invention, the lower suspension line and the upper suspension line may be a single, continuous strand of wire.

In accordance with another aspect of the present invention, there is a method for forming a control joint along a fracture axis in a monolithic pour concrete structure. The concrete structure may be generally defined by a first edge form section and a second edge form section. The method may include the step of attaching an upper suspension line to the first edge form section and a second edge form section. The upper suspension line may be substantially parallel to the fracture axis. Next, the method may include the step of coupling a sheath to the upper suspension line. The sheath may be suspended within the space defined by the first edge form section and the second edge form section. The method may further include the step of pouring concrete in a plastic state into the space defined by the first edge form section and the second edge form section. The method may conclude with the step of removing the upper suspension line and the sheath from the concrete structure.

Alternatively, the method may include the step of attaching a lower suspension line to the first edge form section and the second edge form section. The sheath may be coupled to the lower suspension line, and the final step of the method may include removing the lower suspension line.

The present invention will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which like numbers refer to like parts throughout, and in which.

Common reference numerals are used throughout the drawings and the detailed description to indicate the same elements.

DETAILED DESCRIPTION OF THE INVENTION

The detailed description set forth below in connection with the appended drawings is intended as a description of the presently preferred embodiment of the invention, and is not intended to represent the only form in which the present invention may be constructed or utilized. It is understood that the use of relational terms such as first and second, top and bottom, left and right, front and rear, and the like are used solely to distinguish one from another entity without necessarily requiring or implying any actual such relationship or order between such entities.

Figure 1:
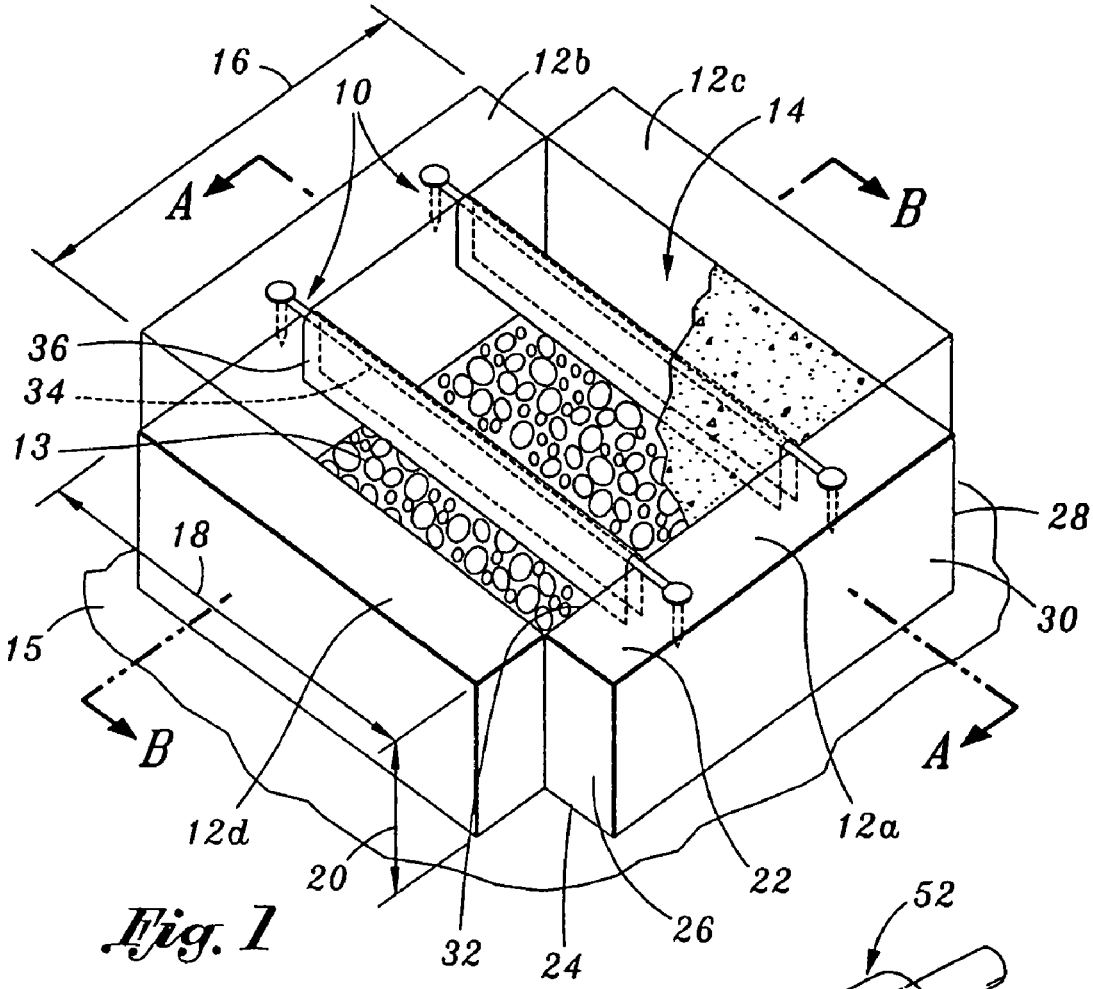
FIG. 1 is a perspective view of a first embodiment of a fracture control joint assembly including a sheath embedded within a concrete structure in accordance with one aspect of the present invention.

With reference to FIG. 1, a first embodiment of a fracture control joint assembly 10 is installed on forms 12, specifically, on a first form 12*a* and a generally opposed second form 12*b*. The forms 12 define a three-dimensional space comprising a monolithic pour concrete structure 14, and are typically constructed of wood or other like rigid material such as metal. Generally, industry standard cuts of lumber such as the ubiquitous two-by-four and the like are utilized. Under the concrete structure 14 and the forms 12 is a base course 13 comprised of aggregate such as crushed stones, and under the base course 13 is a compacted subgrade 15. The techniques and materials utilized in preparing the underlying surface for the monolithic concrete pour, particularly with regard to the base course 13 and the subgrade 15, are well known in the art.

Further, as explained in the background above, monolithic pour refers to the concrete construction technique in which the entire structure is formed in a single pour. It will be appreciated that the general concept of the monolithic pour may be applicable to standard Portland cement concrete, surface seeded exposed aggregate concrete, or any other concrete type. Accordingly, the present invention is not limited to any particular concrete material.

In further detail regarding the forms 12, each defines the width 16, the length 18, and the height or thickness 20 of the concrete structure 14. Each of the forms 12 includes a top surface 22, a bottom surface 24, a left side surface 26, a right side surface 28, a front surface 30, and a rear surface 32. The rear surface 32 is adjacent to the concrete structure 14, while the bottom surface 24 faces the ground. It will be appreciated by one of ordinary skill in the art that the configuration and arrangement of the forms 12 are presented by way of example only and not of limitation, and any suitable shape besides the quadrangular, edge-to-edge layout illustrated in FIG. 1 may be substituted without departing from the scope of the present invention. In addition to being referred to as forms 12, such entities that define the edges of the concrete structure 14 may also be referred to as edge form sections.

The first embodiment of the fracture control joint assembly 10 includes an upper suspension line 34 extending between the first form 12*a* and the second form 12*b*, and a fracture inducing sheath 36 suspended within the concrete structure 14 from the suspension line 34. The suspension line 34 has a proximal end 34*a* fixed to the first form 12*a*, and a distal end 34*b* fixed to the second form 12*b*. The upper suspension line 34 is pulled taught with sufficient force to support the sheath 36 without sagging in the middle. In order to maximize holding strength and resiliency without being excessively bulky, the upper suspension line 34 is preferably constructed of eight gauge metallic wire, which may be comprised of multiple, smaller strands, or a single strand. The diameter of the upper suspension line 34 is dependent on the cross-sectional width of the sheath 36. One of ordinary skill in the art will be able to select the optimal characteristics of the upper suspension line 34, and the present invention is not limited to any particular wire configuration.

Figure 2:
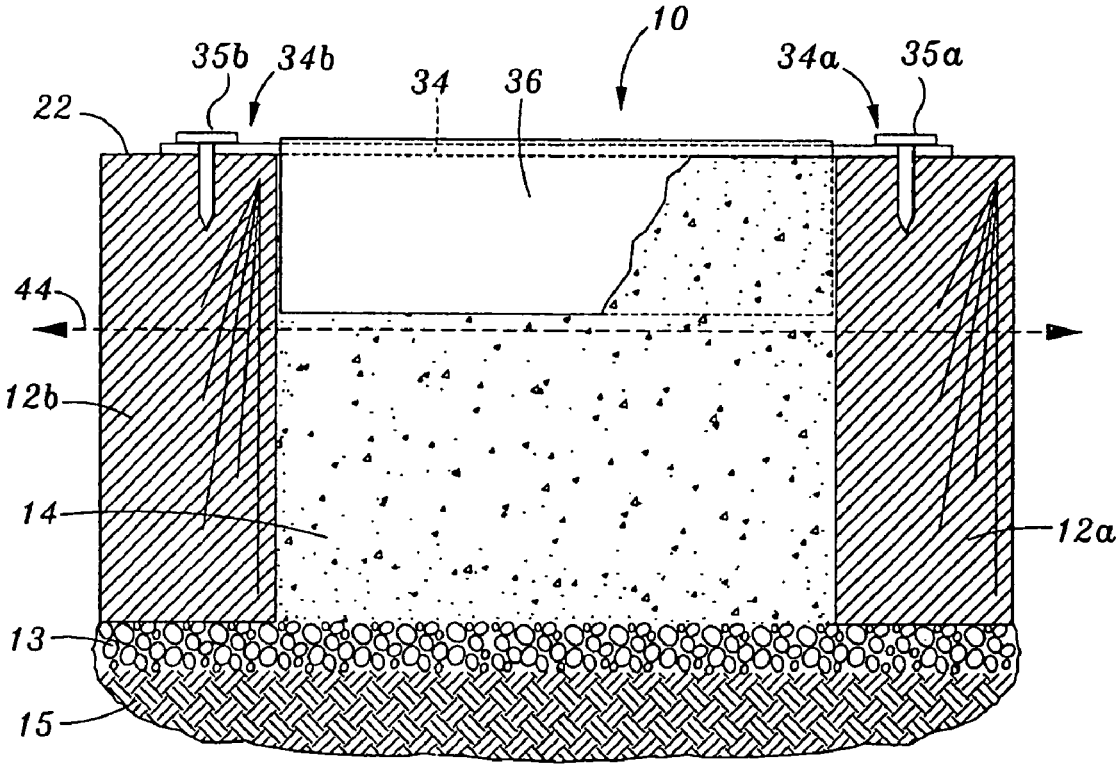
FIG. 2 is a cross-sectional view of the first embodiment of the fracture control joint assembly taken along axis A-A of FIG. 1.
Figure 3:
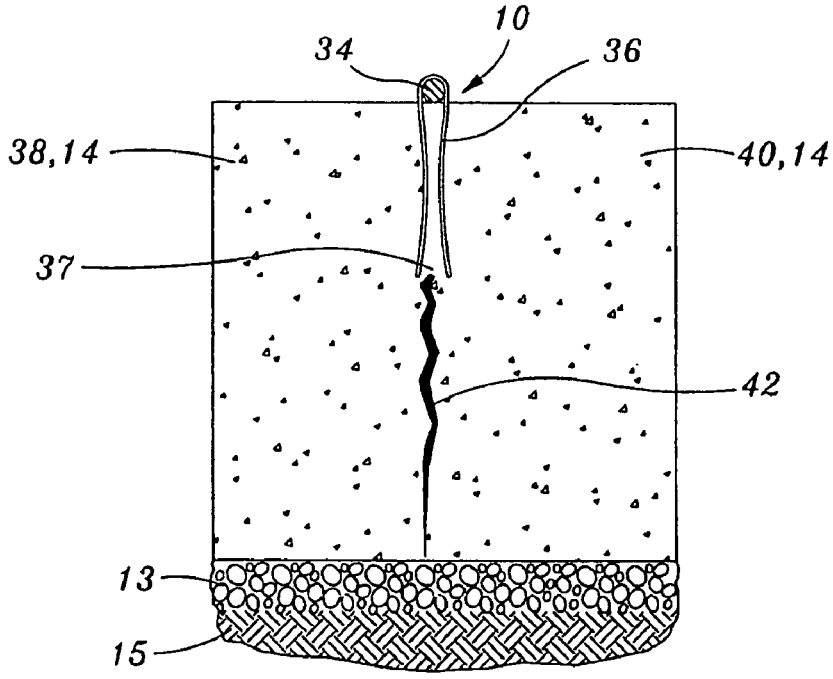
FIG. 3 is a cross-sectional view of the first embodiment of the fracture control joint assembly as taken along axis B-B of FIG. 1.

As illustrated in FIGS. 2 and 3, in one embodiment the upper suspension line 34 is fixed to the first and second forms 12*a*, 12*b* with fasteners 35*a*, 35*b*. The fasteners 35*a*, 35*b* are preferably nails, screws, and the like. Typically, the proximal and distal ends 34*a*, 34*b* are looped around the shaft of, or otherwise secured to, the fasteners 35*a*, 35*b*, and driven into the forms 12*a*, 12*b*. Thus, the upper suspension line 34 is compressively retained by the fasteners 35*a*, 35*b*, and the forms 12*a*, 12*b*. It is understood that the suspension line 34 lies flush against the upper surface 22 of the forms 12*a*, 12*b*.

It is understood that upon pouring concrete to form the concrete structure 14, the fracture inducing sheath 36 introduces a void 37 segregating the concrete structure 14 into a first section 38 and a second section 40. As indicated above in the background of the invention, the concrete structure 14 is weakened in strategic locations to induce cracking or fracturing in the vicinity of such weakened locations. It is understood that the void 37 is such a weakened location, and aids in inducing a fracture 42 upon expansion or contraction during and after curing.

Generally, the fracture 42 defines a fracture axis 44. The void 37, the suspension line 34, and the fracture inducing sheath 36 are all parallel to the fracture axis 44. The fracture 42 extends vertically from the void 37 to the base course 13. As particularly illustrated in FIG. 2, the fracture inducing sheath extends between the boundaries of the concrete structure 14, that is, between the first and second forms 12*a*, 12*b*. Accordingly, it is understood that the void 37 introduced by the sheath 36 similarly extends between the first and second forms 12*a*, 12*b*. As indicated above, it is desirable to divide a single block of concrete into multiple sections which can expand and contract independently of another. Extending the fracture 42 to the periphery of the concrete structure 14 as explained above, i.e., to the edge adjacent to the forms 12 as well as to the bottom surface immediately above the base course 13, facilitates the formation of such multiple segments. The size of the fracture 42 between the first section 38 and the second section 40 may depend upon the degree of expansion or contraction the concrete structure 14 has undergone. More specifically, it will be appreciated that concrete contracts as it cures, and under low temperature, while it expands under high temperature and as stress is applied, typically in the form of vehicular or foot traffic.

Figure 4:
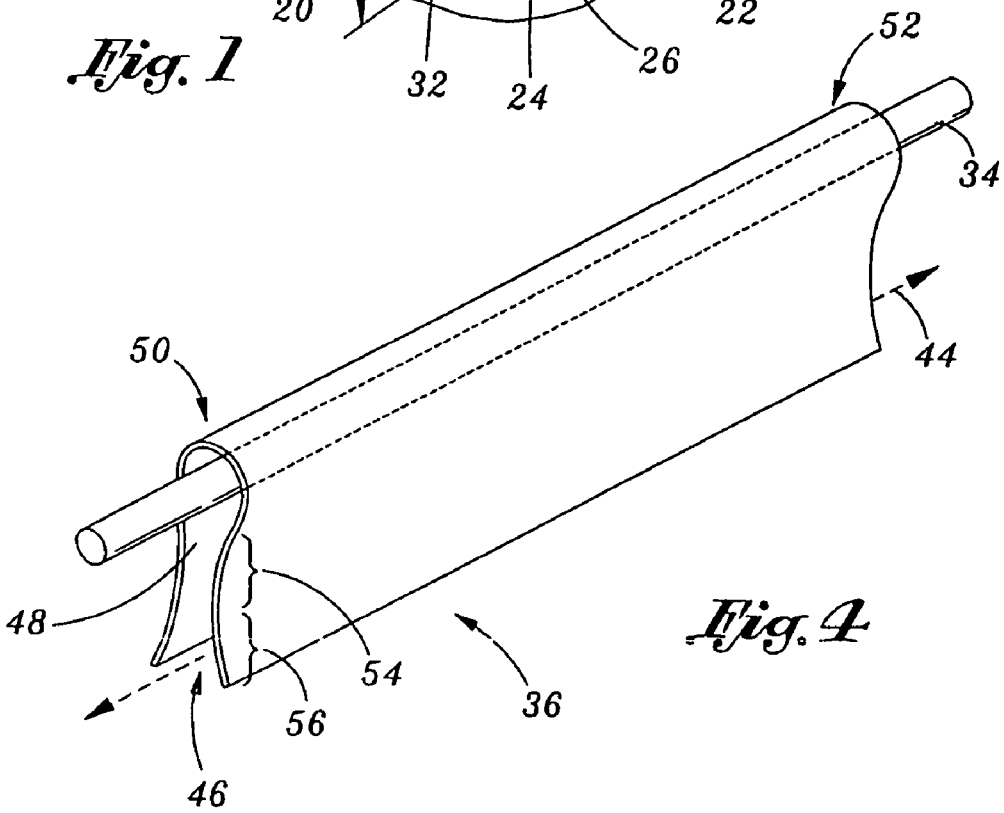
FIG. 4 is a detailed perspective view of the fracture inducing sheath suspended from an upper suspension line in accordance with an aspect of the first embodiment of the present invention.

As illustrated in FIG. 4, the fracture inducing sheath 36 of the first embodiment is suspended from the upper suspension line 34, which is parallel to the fracture axis 44. The sheath 36 defines an elongate slit 46 and an upper internal channel 48, both of which extend along the length of the sheath 36 to define open ends 50, 52 thereof. The elongate slit 46 exposes the upper internal channel 48, which receives the upper suspension line 34. The slit 46 is defined by a narrow section 54 and a widened section 56 of the sheath 36. The upper internal channel 48 has a diameter sufficient to accommodate the upper suspension line 34, and the width of the slit 46 at its most narrow section 54 is preferably less than the diameter of the upper suspension line 34 and consequently, the diameter of the upper internal channel 48. Thus, the cross-section of the sheath 36 is a reverse U-shape. Preferably, the sheath 36 is constructed of plastic according to any one of numerous techniques known in the art, such as molding and extruding. However, any alternative material, for example, sheet metal, which has sufficient rigidity and flexibility, may be readily substituted without departing from the scope of the present invention.

It will be appreciated that the above-described configuration of the sheath 36 enables the same to retain the upper suspension line 34 within the upper internal channel 48. Thus, as concrete is poured, the tendency of the sheath 36 to be raised in along with the height of the concrete is resisted by the compressive forces exerted on the narrow section 54. Additional force may be applied during removal to widen the narrow section 54 such that the upper suspension line 34 can be passed through the slit 46. It will also be appreciated that the widened section 56 is bowed out such that there is more room in positioning and aligning the sheath 36 along the upper suspension line 34. A downward force may be applied to the sheath 36 to widen the narrow section 54 for insertion of the upper suspension line 34.

Figure 5:
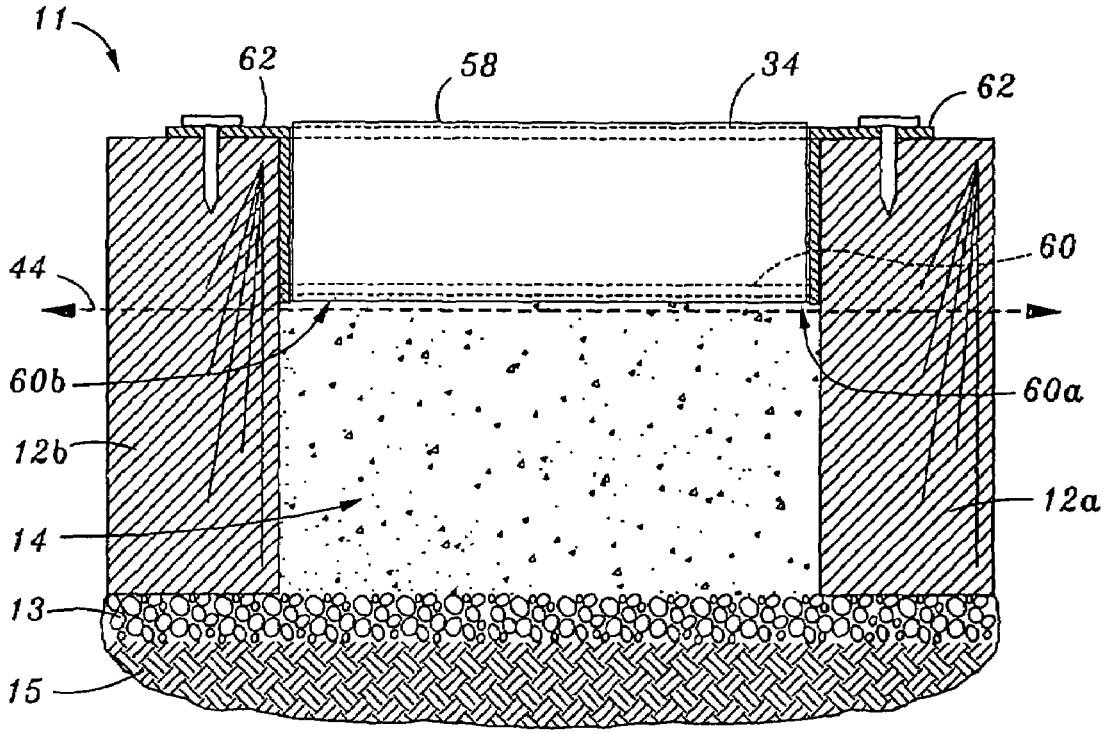
FIG. 5 is a cross-sectional view of the second embodiment of a fracture inducing sheath embedded within the concrete structure.
Figure 6:
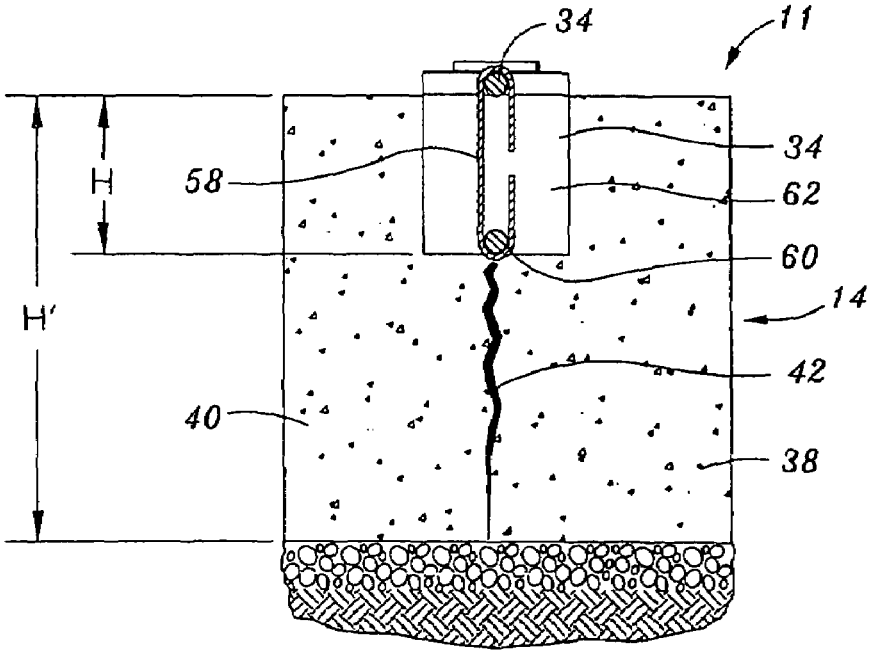
FIG. 6 is a cross-sectional view of the second embodiment of the fracture inducing sheath embedded within the concrete structure, taken perpendicularly to the view of FIG. 5.

With reference to FIGS. 5 and 6, a second embodiment of a fracture control joint assembly 11 includes a fracture inducing sheath 58 suspended from the upper suspension line 34, and further braced by a lower suspension line 60. The lower suspension line 60 is pulled taught and extends from the first form 12*a* to the second form 12*b* in a parallel relationship to the upper suspension line 34 and the fracture axis 44. More specifically, the lower suspension line 60 is defined by a proximal end 60*a* fixed to the first form 12*a*, and by a distal end 60*b* fixed to the second form 12*b*. As explained above in relation to the upper suspension line 34, the lower suspension line 60 may likewise be metallic wire comprised of multiple strands or a single strand, and may be of any desirable size capable of being enclosed within the sheath 58.

Figure 7:
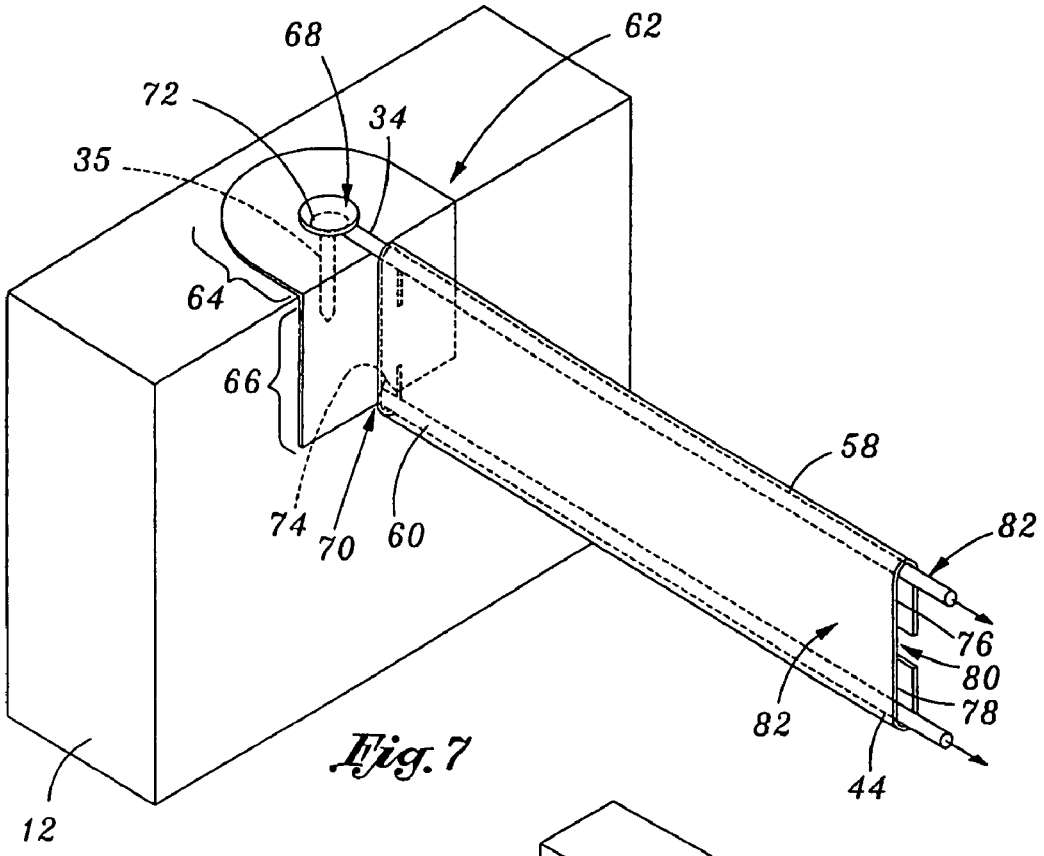
FIG. 7 is a detailed perspective view of the fracture inducing sheath suspended from the upper suspension line and further supported by a lower suspension line, and the upper and lower suspension lines being fixed to the form with the bracket in accordance with an aspect of the present invention.

The upper suspension line 34 and the lower suspension line 60 are fixed to the first and second forms 12*a*, 12*b* with a bracket 62. With further reference to FIG. 7, the bracket 62 includes a horizontal section 64 and a vertical section 66. The horizontal section 64 defines a first attachment point 68 for the upper suspension line 34, and the vertical section 66 defines a second attachment point 70 for the lower suspension line 60. The bracket 62 may be constructed of metal, plastic, or any other suitable material. The first attachment point 68 is a fastener aperture 72 defined by the bracket 62 and having a sufficient diameter to accommodate insertion of the shaft portion of the fastener 35, while preventing the head portion of the fastener 35 from passing through. As indicated above, the upper suspension line 34 may be wrapped around the fastener 35. Further, the upper suspension line 34 may be compressively retained by the head of the fastener 35 and the bracket 62. The second attachment point 70 of the lower suspension line 60 is a line retention notch 74. It is understood that the lower suspension line 60 is frictionally retained, with the bracket 62 partially cutting into the same. In order to properly align the upper suspension line 34 and the lower suspension line 60, it is understood that the respective centers of the first attachment point 68, i.e., the fastener aperture 72, and the second attachment point 70, i.e., the line retention notch 74, are aligned with the fracture axis 44.

According to one embodiment, the upper suspension line 34 and the lower suspension line 60 are separate strands of wire, in other embodiments the two suspension lines may be a continuous strand. Specifically, the upper suspension line 34 may be passed through the fastener aperture 72 and routed around the form 12 to the line retention notch 74, and extend to the opposing form 12, and so forth. Any desirable routing technique for the upper suspension line 34 and the lower suspension line 60 may be readily substituted without departing from the scope of the present invention.

With reference to FIGS. 5 and 6, the sheath 58 is suspended within the concrete structure 14, generally dividing the same into the first section 38 and the second section 40. The concrete structure 14 is disposed on the base course 13 and the subgrade 15, as indicated above in relation to the first embodiment of the present invention. Along these lines, the sheath 58 likewise generates a weakness in the concrete structure 14 which is operative to develop a fracture 42 which extends generally parallel to the fracture axis 44. Preferably, the height H of the sheath 58 is approximately a third of the height H' of the form 12.

In further detail with reference to FIG. 7, the sheath 58 defines an upper internal channel 76, and an opposed lower internal channel 78, both of which extends along the length of the sheath 58. The upper internal channel 76 and the lower internal channel 78 are exposed via a slit 80 defining a side portion 82 of the sheath 58. Thus, the sheath 58 generally has a C-shaped cross section, where the slit 80 serves as an insertion path for the upper suspension line 34 and the lower suspension line 60. Upon installation of the sheath 58 on the suspension lines, the upper suspension line 34 is understood to traverse the upper internal channel 76, and the lower suspension line 60 is understood to traverse the lower internal channel 78. In this regard, it is understood that the upper suspension line 34 and the lower suspension line 60 are configured to flex inwardly towards each other so as to temporarily fit within the slit 80 for installation of the sheath 58.

With further reference to FIG. 5, it will be appreciated that as concrete is poured, the sheath 58 has a tendency to rotate about the upper suspension line 34, moving the same towards either the first section 38 or the second section 40. The lower suspension line 60 aids in resisting such a tendency, keeping the sheath 58 aligned with the fracture axis 44. Additionally, the lower suspension line 60 serves to limit lateral rotation about the first attachment point 68 resulting from the flexibility in the upper suspension line 34.

Figure 8:
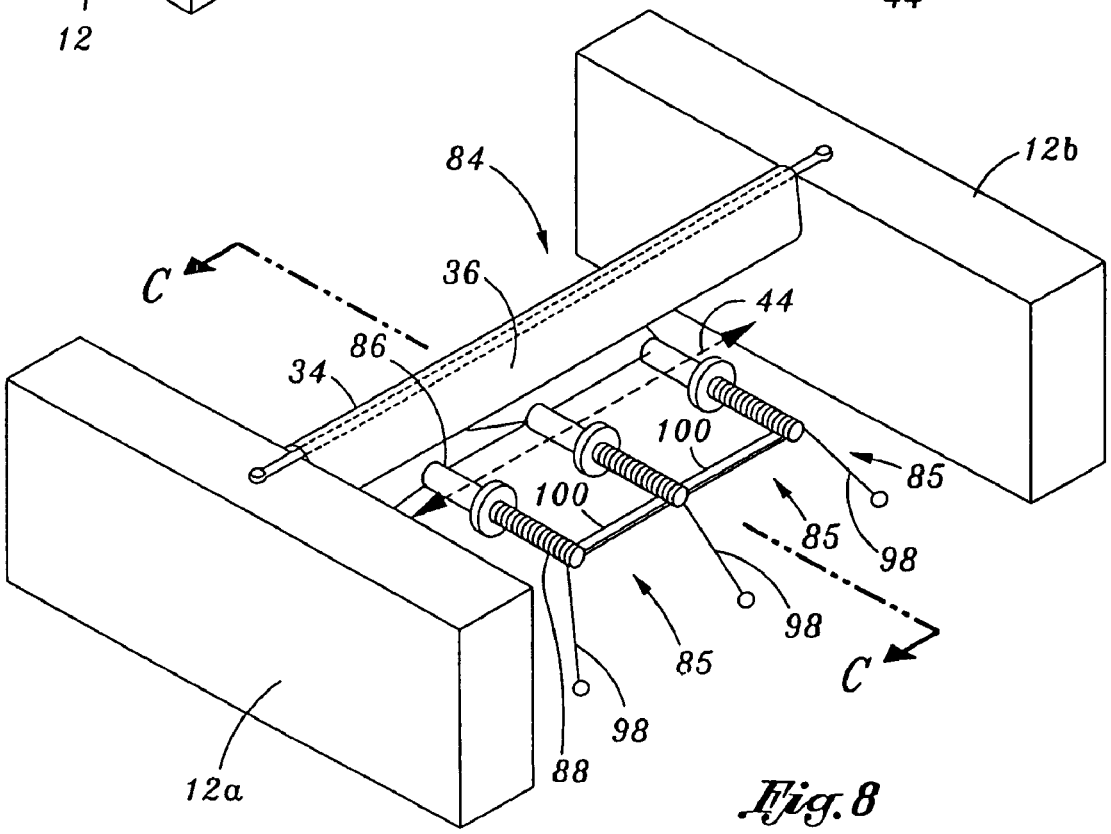
FIG. 8 is a perspective view of the fracture control joint assembly in conjunction with a dowel basket.
Figure 9:
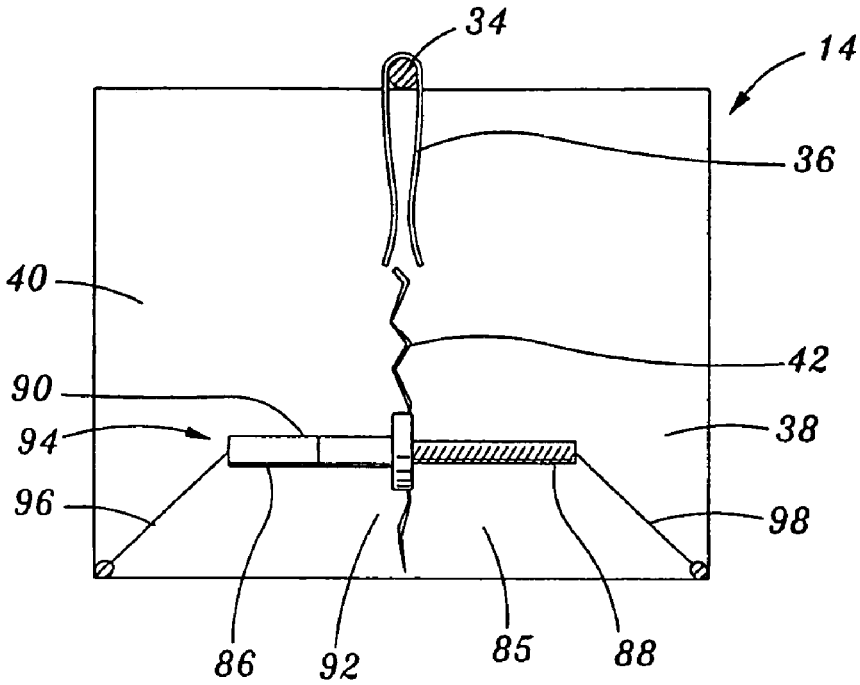
FIG. 9 is a cross sectional view of the fracture control joint assembly with the dowel basket, taken along axis C-C of FIG. 8.

It will be appreciated by one of ordinary skill in the art that either one of the aforementioned embodiments of the joint assemblies 10, 11 may further include lateral reinforcement assemblies, otherwise known as dowel baskets. With reference to FIGS. 8 and 9, the fracture inducing sheath 36 of the first embodiment is shown suspended from the upper suspension line 34, the sheath 36 and the suspension line 34 being parallel with the fracture axis 44. A dowel basket 84 includes one or more reinforcement members that are disposed transversely across the fracture axis 44 and the sheath 36. Each one of the reinforcement members is comprised of a dowel cover or sleeve 86 and a corresponding tubular dowel 88 inserted therein. The dowel cover 86 defines a hollow interior 90 to accommodate the tubular dowel 88, an open flanged end 92, and a closed end 94. The open flanged end 92 is preferably contiguous with the fracture 42. In this regard, devices that align the reinforcement members with the sheath 36 are deemed to be within the scope of the present invention. The closed end 94 is attached to a support member 96 which raises the height of the dowel cover 86. The dowel 88 is also attached to a support member 98, which is configured identically to the support member 96 to enable the mating of the dowel 88 to the dowel cover 86. The assembly comprising the dowel cover 86, the dowel 88, and the support members 96, 98 is referred to as a basket module 85.

With particular reference to FIG. 8, each basket module 85 is connected to the subsequent basket module 85 with an interconnecting member 100, which comprises the dowel basket 84. The interconnecting members 100 are preferably a rebar or other like metallic rod, and may be welded to the support members 96 or 98. One of ordinary skill in the art will readily recognize numerous variations to the aforementioned dowel basket 84, including the dowel 88 and the dowel cover 86, and it is expressly contemplated that any such variation is deemed to be within the scope of the present invention. It will be further appreciated that the dowel 88 and the dowel cover 86 are disposed extend into opposite sections of the concrete structure 14 such that expansion and contraction only occur laterally. As indicated above, the dowel 88 prevents bucking and other damage resulting shear stresses. Although normally relegated to use in forming "cold joints," the dowel basket 84 permits the use of such devices in monolithic pour concrete systems as those of the present invention.

Figure 10:
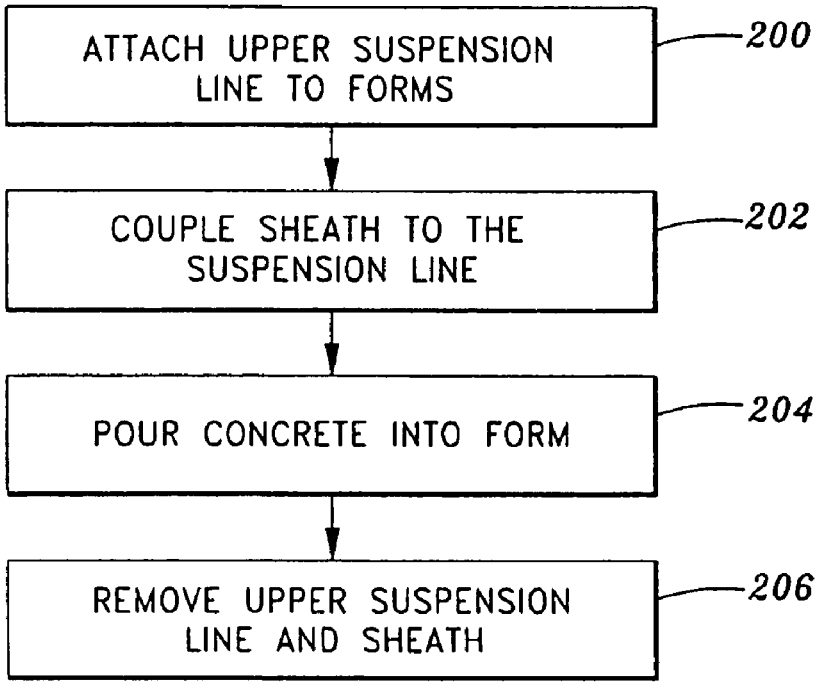
FIG. 10 is a flowchart depicting a method for forming a control joint in accordance with an aspect of the present invention.
Figure 11A:
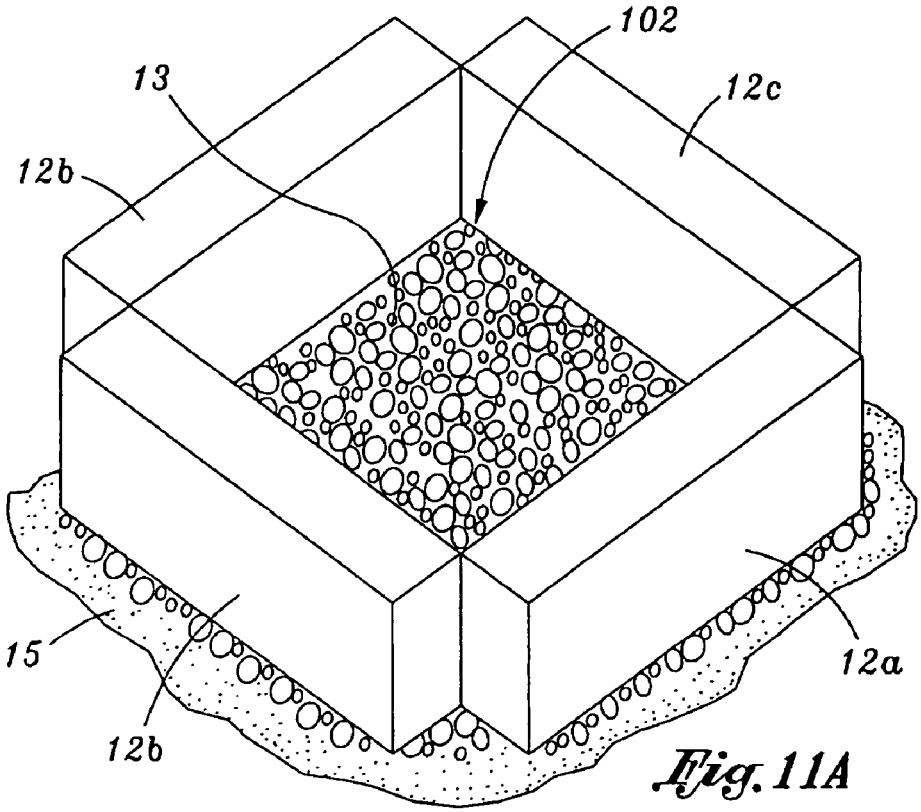
FIG. 11*a-d* are perspective views of the fracture control joint is various stages of completion in accordance with the method as set forth in one aspect of the present invention.

Referring to FIGS. 10, and 11*a-d*, the present invention further contemplates a method for forming a control joint along a fracture axis in a monolithic pour concrete structure. As illustrated in FIG. 11*a*, the first form 12*a*, the second form 12*b*, the third form 12*c*, and the fourth form 12*d*, collectively referred to as the forms 12, are arranged in a desired configuration, which is quadrangular in the present illustrative example. The forms 12 are disposed above the base course 13 of aggregate, and above the subgrade 15. The space defined by the bounds of the forms 12 is referred to as a pour space 102.

Figure 11B:
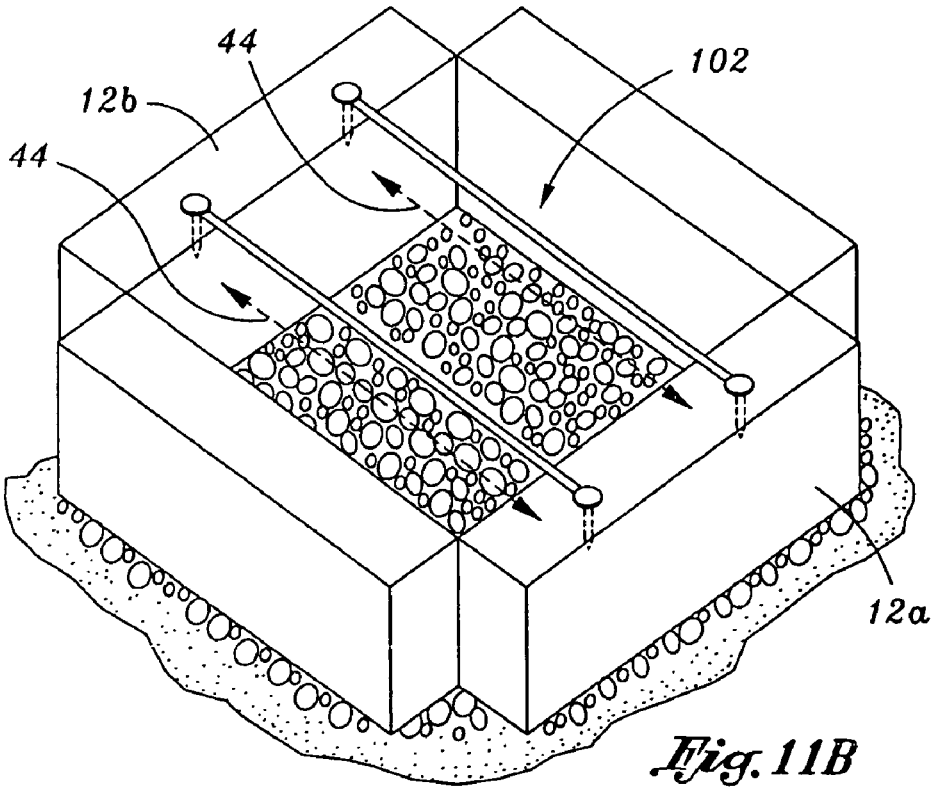

According to step 200, and as further illustrated in FIG. 11*b*, the upper suspension line 34 is attached to the forms 12, specifically, opposed forms 12*a* and 12*b*. As indicated above, the upper suspension line 34 is parallel to the fracture axis 44, since by definition it is determined by the orientation of the upper suspension line 34. The upper suspension line 34 also extends slightly above the pour space 102.

Figure 11C:
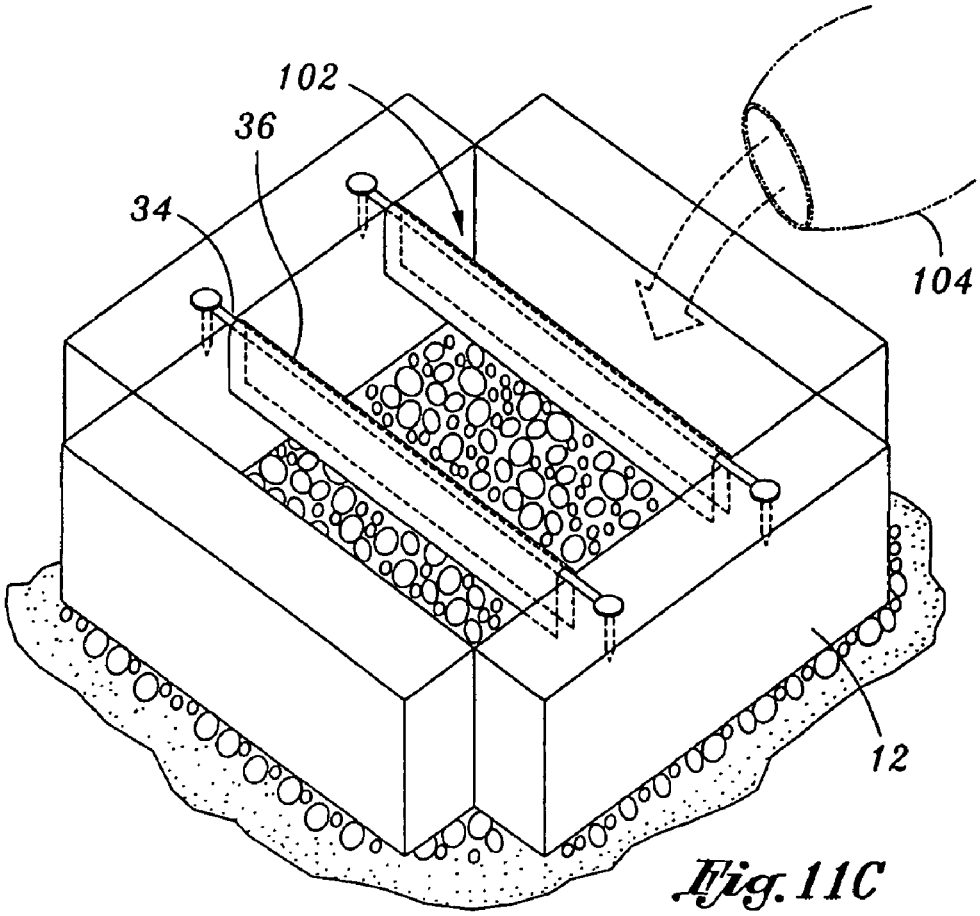

With reference to FIGS. 10 and 11*c*, per step 202 the sheath 36 is coupled to the upper suspension line 34. Thus, the sheath 36 is suspended from the upper suspension line 34 and within the pour space 102. Next, step 204 calls for the pouring of concrete 104 into the pour space 102. As will be readily understood by one of ordinary skill in the art, the concrete 104 is in a plastic state, and has been prepared according to well known techniques. As explained above, the concrete 104 may be standard Portland cement concrete, or any other type of concrete.

Figure 11D:
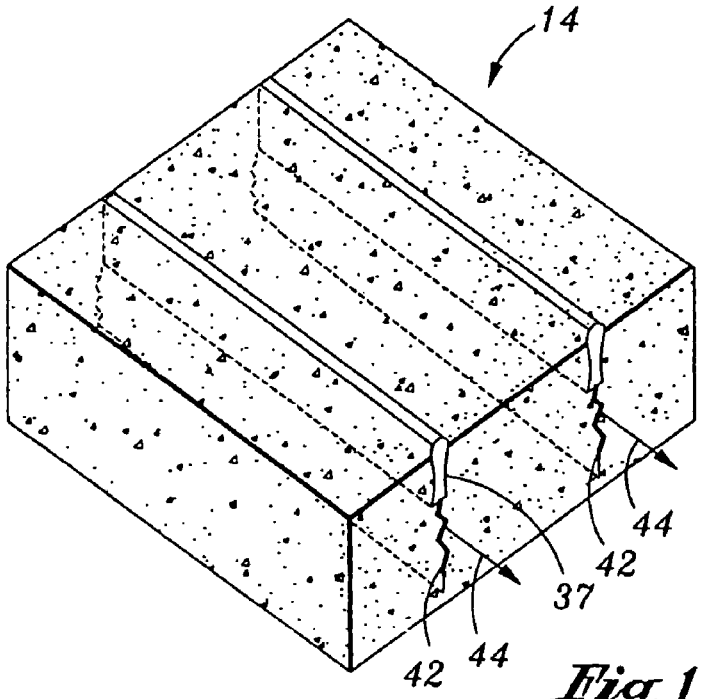

After curing, per step 206 the sheath 36 and the upper suspension line 34 is removed from the concrete structure 14. The forms 12 may be removed from the concrete structure 14 as well. As illustrated in FIG. 11*d*, the removal of the upper suspension line 34 and the sheath 36 results in the void 37 between segments of the concrete structure 14. As indicated above, the void 37 facilitates the formation of the fractures 42 along the fracture axis 44. Along these lines, it will be appreciated that the flexible characteristics of the sheath 36 facilitates the removal from the cured concrete structure 14.

One of ordinary skill in the art will recognize that while the present inventive method has been described with reference to the first embodiment of the fracture control joint 10, the method may also be practiced with the second embodiment of the fracture control joint 11, or any other embodiment deemed to be within the scope of the present invention. In this regard, with further reference to FIG. 5, step 200 may also include attaching the lower suspension line 60 to the forms 12 with the bracket 62, and step 202 may include the coupling of the sheath 58 to the lower suspension line 60. Additionally, step 206 may also include removing the lower suspension line 60.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

What is claimed is:

1. A joint assembly for controlling fractures along a fracture axis in a monolithic pour concrete structure defined by a first edge form section and a generally opposed second edge form section, the assembly comprising:

an upper suspension line extending between the first edge form section and the second edge form section along the fracture axis, the upper suspension line defining a proximal end fixed to the first edge form section and a distal end fixed to the second edge form section; and a fracture inducing sheath defining an elongate slit that exposes an upper internal channel defined by the sheath, the slit and the upper internal channel extending along the length of the sheath to define open ends thereof, and an entire cross section of the upper suspension line being enclosed within the upper internal channel in an overlapping relationship to suspend the sheath within the concrete structure.

2. The joint assembly of claim 1, wherein the width of the slit is smaller than the width of the upper internal channel to retain the upper suspension line therein.

3. The joint assembly of claim 1, wherein the fracture inducing sheath is extruded plastic.

4. The joint assembly of claim 1, further comprising a lateral reinforcement assembly in the concrete structure, the assembly comprising:

a plurality of reinforcement members disposed transversely across the fracture axis and the sheath, each reinforcement member having a sleeve and a tubular dowel inserted therein; and a basket assembly with the plurality of reinforcement members mounted thereto, the basket assembly including a plurality of support members, a plurality of interconnecting members attaching one of the support members to another one of the support members.

5. The joint assembly of claim 1, further comprising:

fasteners securing the proximal and distal ends of the upper suspension line to the respective one of the first and second edge form sections.

6. The joint assembly of claim 5, wherein the first edge form section and the second edge form section each define an upper surface, the fasteners being driven through the upper surface.

* * * * *